US005193116A

United States Patent [19]

Mostardo

[11] Patent Number: 5,193,116

[45] Date of Patent: Mar. 9, 1993

[54] HEARING AND OUTPUT TRANSDUCER WITH SELF CONTAINED AMPLIFIER

[75] Inventor: August F. Mostardo, Norridge, Ill.

[73] Assignee: Knowles Electronics, Inc., Itasca, Ill.

[21] Appl. No.: 759,480

[22] Filed: Sep. 13, 1991

[51] Int. Cl.[5] ..... H04R 25/00

[52] U.S. Cl. ..... 381/69; 381/68; 381/68.6; 381/199

[58] Field of Search ..... 381/200, 199, 189, 201, 381/68, 68.4, 68.6, 69, 69.1

[56] References Cited

U.S. PATENT DOCUMENTS

| | | | |
|---|---|---|---|
| 3,733,445 | 5/1073 | Sebesta | 381/200 |
| 4,109,116 | 8/1978 | Victoreen | 381/68 |
| 4,417,677 | 5/1984 | Miyahra et al. | 381/68.7 |
| 4,592,087 | 5/1986 | Killion | 381/68.6 |
| 4,628,907 | 12/1986 | Epley | 381/68.3 |
| 4,689,819 | 8/1987 | Killion | 381/68.4 |
| 4,807,294 | 2/1989 | Iwata et al. | 381/158 |
| 4,956,868 | 9/1990 | Carlson | 381/189 |
| 5,068,901 | 11/1991 | Carlson | 381/69 |

*Primary Examiner*—Jin F. Ng
*Assistant Examiner*—Huyen D. Le
*Attorney, Agent, or Firm*—Wallenstein, Wagner & Hattis, Ltd.

[57] ABSTRACT

An integrated hearing aid receiver is disclosed. The receiver comprises a housing having first and second outlet ports. Disposed within the housing is a diaphragm defining an output chamber and a motor chamber. An armature is disposed within the motor chamber, and has an operative element comprising a fixed end and a movable end. The armature operative element is coupled by a link to drive the diaphragm. A permanent magnet structure having a central passage therein surrounds the movable end of the armature and provides a magnetic field within the passage. A drive oil is disposed about the armature and is located proximate to the permanent magnetic structure. An amplifier is disposed within the motor chamber and between the armature and the diaphragm. Lead attachment between relatively fragile amplifier output leads and drive coil leads 66 is achieved by disposing the drive coil leads to extend from a base portion of the drive coil upwardly about its peripheral surface and having their end portions extending at an angle towards the amplifier. The amplifier leads are brought upward from the interior of the housing and into contact with the drive coil leads. Associated lead pairs are welded together, after which the drive coil leads are folded towards the amplifier and downward, thereby minimizing tensile stress in the amplifier leads.

17 Claims, 2 Drawing Sheets

HEARING AND OUTPUT TRANSDUCER WITH SELF CONTAINED AMPLIFIER

TECHNICAL FIELD

The technical field of the invention is the electronic hearing aid art.

BACKGROUND OF INVENTION

Miniaturized hearing aid receiver transducers as part of a complete hearing aid system small enough to be self contained within an ear-mounted hearing aid are well known. There is, however, a continuing effort to further reduce the size of the associated elements. In particular, the receiver and its associated power amplifier occupy a significant fraction of the total available volume of the hearing aid system, and efforts continue to reduce their size. It is known to incorporate a power amplifier into a receiver housing. One such integrated receiver is disclosed in U.S. Pat. No. 4,689,819. In this unit, the amplifier is placed completely outboard of the armature structure. In an effort to reduce the size of the housing, receiver units have also been fabricated having an armature cantilevered from an end wall with the amplifier disposed below the fixed end of the armature. This particular armature structure complicates assembly, and the overall design did not lend itself to achieving the desired minimum housing volume.

Another problem that arises during the manufacture of integrated receivers is that the relatively fragile output leads from the amplifier must be connected to relatively massive drive coil leads. It is not uncommon during manufacture to lose an expensive, almost completely assembled receiver because one of the amplifier leads is accidently broken during the attachment process.

The present invention is provided to solve these and other problems.

SUMMARY OF THE INVENTION

It is an object of the invention to provide a novel construction of an integrated hearing aid receiver.

The receiver comprises a housing having a first outlet port and a diaphragm disposed within the housing. The diaphragm defines a motor chamber and an output chamber, the output chamber communicating with the first outlet port. An armature is disposed within the chamber and has an operative element comprising a fixed end and a movable end. Coupling means are providing for operatively coupling the armature to the diaphragm. A permanent magnet structure disposed about the armature provides a magnetic field at the movable end. The drive coil is disposed about the armature adjacent the permanent magnet structure, and the amplifier is disposed between the armature and the diaphragm.

In the preferred form of the invention, the amplifier is disposed at the fixed end of the armature adjacent to the drive coil. The armature is configured as a U-shaped strap having opposed legs. One of the legs serves as the operative element of the armature, and the other of the legs is fixed to the housing. The amplifier is a pulse width modulation amplifier, and use is made of the very low output impedance of such amplifiers to allow use of a substantially shortened drive coil to provide the necessary mounting space.

The amplifier is mounted upon a planar mounting board having input and power terminals configured as metallizations extending to a common board edge. The mounting board extends through a second outlet port communicating with the motor chamber. In the preferred form of the invention, the amplifier is disposed adjacent to the drive coil, and is separated therefrom by a gap. A coupling link extends from the exposed armature portion through the gap and to a central region of the diaphragm. The housing is generally rectangular in crosssection. The armature thickness is approximately 0.006" thick, which provides a proper 2.6 kHz output resonance.

It is also an object of the invention to provide an improved method for attaching relatively fragile amplifier output leads to relatively massive drive coil leads. The drive coils are configured so that the drive coil leads emerge from lower, opposite sides of the drive coil extending generally away from the amplifier, and are brought up around the peripheral sides out of the lower housing half to extend upwardly and at an angle towards the amplifier. The amplifier leads are drawn upward and forward at an angle to contact their associated coil leads, and are welded to them, preferably by tweezer welding. The coil lead end is then folded downward towards the amplifier to lie generally flush against the upper coil surface, thereby folding the associated amplifier lead without inducing tensile stress. This technique greatly reduces the possibility of pulling the relatively fragile amplifier output leads loose during the assembly process.

Other features and advantages of the invention will be evident from the specification to follow, the claims and the drawings.

DESCRIPTION OF INVENTION

Figure 2:
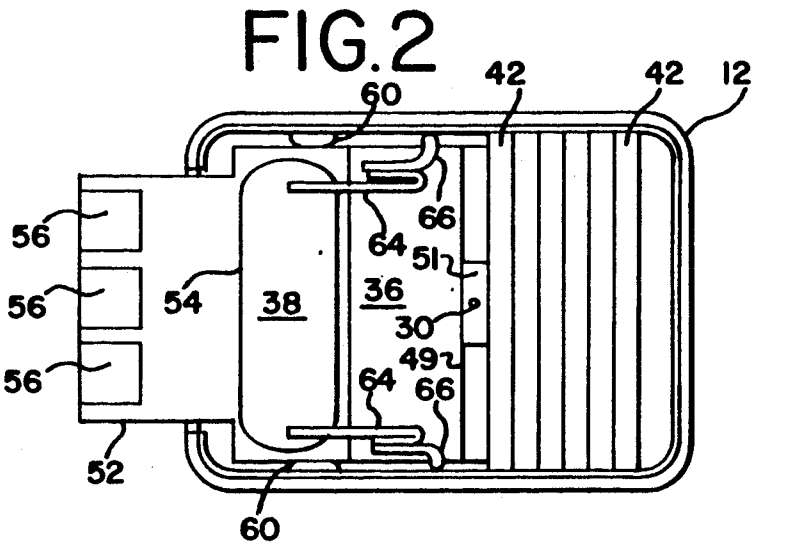
FIG. 2 is a plan view of the integrated receiver of FIG. 1 with the uppermost elements thereof removed.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiment illustrated.

Figure 1:
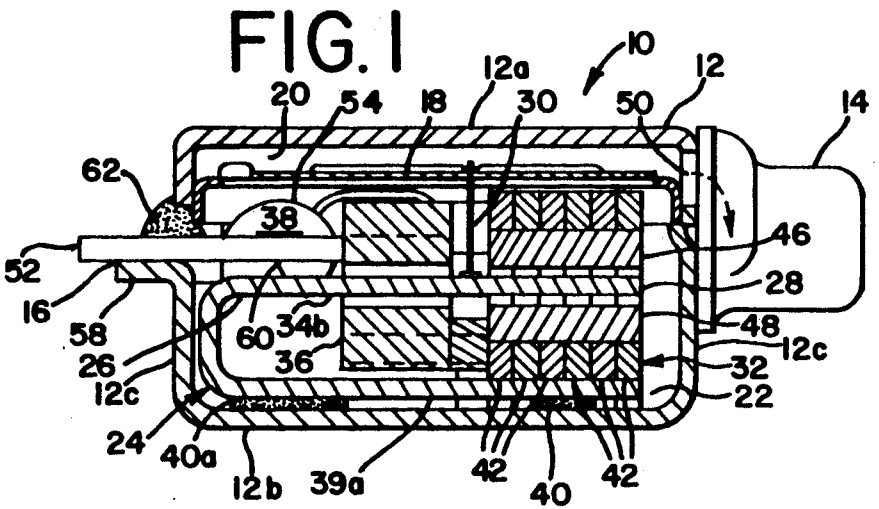
FIG. 1 is a partially Cut away side view of an integrated hearing aid receiver in accordance with the invention.

Referring to FIG. 1, a hearing aid receiver 10 comprises a housing 12 having first and second outlet ports 14,16, respectively. A diaphragm 18 is disposed within the housing 12, defining an output chamber 20 and a motor chamber 22. An armature 24 is disposed within the motor chamber 22 and has an operative element comprising a fixed end 26 and a movable end 28. The armature 24 is coupled by a link 30 to drive the diaphragm 18, as is well known. A permanent magnet structure 32 having a central passage 34 surrounds the movable end 28 of the armature 24 and provides a permanent magnetic field within the passage 34. A drive coil 36 is disposed about the armature 24 and is located proximate to the permanent magnet structure 32. An amplifier 38 is disposed within the motor chamber 22 and between the armature 24 and the diaphragm 18.

Figure 3:
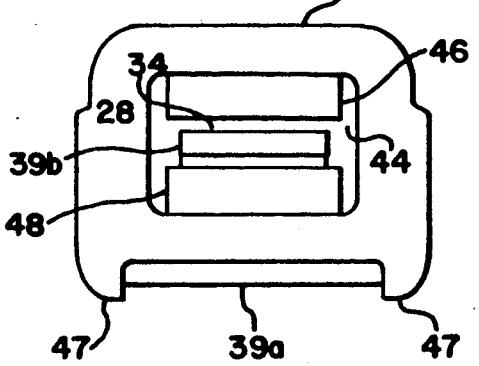
FIG. 3 is an end view of interior elements of the integrated receiver of FIG. 1, with the housing and upper structure removed.

The housing 12 is generally rectangular in cross-section, having generally planar top 12*a*, bottom 12*b* and side walls 12*c*. The armature 24 is configured as a generally U-shaped strap having first and second opposed legs 39*a*, 39*b*, respectively. The first leg 39*a* is adhesively secured to the housing wall of the motor chamber 22 opposite the diaphragm 18 by means of adhesive 40. As will be noted from FIG. 3, the second leg 39*b* of the armature 24 is narrower than the first leg 39*a*. The second leg 39*b* terminates in the movable end 28 of the armature 24, and its left most end is sufficiently close to the first leg 39*a* so as to be substantially immobile.

Referring again to FIG. 1, the permanent magnet structure 32 comprises a stack of ferromagnetic laminations 42, each having an aligned central lamination aperture 44. A pair of permanent magnets 46,48 are disposed within the lamination apertures 44 and cemented to opposite faces thereof. The lower faces of the laminations 42 are welded to the right most end of the fixed leg 39*a* of the armature 24. This serves to complete the magnetic circuit around the armature loop. Downwardly extending legs 47 (FIG. 3) extend past the bottom surface of the first leg 39*a* of the armature 24. These legs 47 are welded to the interior of the housing 12 before the cement 40 has set. At this time a suitable quantity of high viscosity damping material 40*a* may be added between the cantilevered portion of the first leg 39*a* and the inside of the housing 12.

Referring to FIG. 2, a C-shaped spacer 49 is upwardly inserted between the permanent magnet structure 32 and the drive coil 36 to provide a passage 51 through which the link 30 passes to couple a central portion of the movable end 28 of the armature 24 to a central portion of the diaphragm 18. Excitation of the drive coil 36 magnetizes the armature 24. Interaction of the armature movable end 28 with the magnetic field causes the armature movable end 28 to vibrate. Movement of the coupled diaphragm 18 produces sound in the output chamber 20, which passes to the outlet port 14 through a passage 50.

The amplifier 38 in the preferred form of the invention is of the pulse width modulation type described in U.S. Pat. No. 4,689,819, the specification of which is incorporated by reference herein. The amplifier 38 is fabricated as an integrated circuit mounted to a ceramic mounting board 52 and surrounded by an encapsulation 54. Metallized contact pads 56 are provided on the outer end of the amplifier board 52. The amplifier board 52 extends a sufficient distance outward from the housing 12 through the second outlet port 16 to allow engagement to a suitable connector. Two of the pads 56 supply positive and negative system power from a battery, and the third pad 56 receives signal input from a suitable microphone and preamplifier. The amplifier board 52 is supported on a shelf 58 extending outward from the housing 12 and on interior shelf-forming protrusions 60 extending inwardly from the sidewalls of the housing 12. The outlet port 16 is sealed by a suitable adhesive sealant 62. Amplifier output leads 64 are connected, preferably by welding, to leads 66 of the drive coil 36.

The amplifier 38, being of the CMOS pulse width modulation type, is characterized by exceptionally low source impedance, typically 50 ohms or thereabout. As a result, considerable signal current can be delivered to the drive coil 36. This signal circuit in turn allows the drive coil to be made short enough so that the amplifier 38 can be disposed within the housing 12 as shown. This low source impedance, however, interacts with the driven electro-mechanical circuit so as to raise the resonant frequency of the armature 24. This resonance produces a significant peak in the frequency response of the system as a whole.

It is desirable that a substantial resonance peak be provided in the vicinity of 2.6 kHz to compensate for loss of a natural sound-augmenting resonance which occurs as a result of occlusion of the ear canal by insertion of a hearing aid thereinto. This subject is dealt with in detail in U.S. Pat. No. 4,807,612, the contents of which are incorporated herein by reference. The resonant frequency is governed by several variables. First, there is the natural resonant frequency of the armature free end 28 coupled to the diaphragm 18. An interaction between the vibrating armature end 28 and the permanent magnet field causes this frequency to be significantly reduced. In conventional structures having a drive coil which occupies the full volume of the housing, such as Model EH as manufactured by Knowles Electronics, Inc., Franklin Park, Ill. USA, this resonance occurs at the requisite 2.6 kHz, provided that a relatively high impedance conventional amplifier is employed. Because the low impedance of the present amplifier 38 raises the resonant frequency of the structure beyond 2.6 kHz, the present structure returns the resonant frequency to 2.6 kHz by thinning the armature 24 from its prior value of 0.007" to 0.006", and by increasing the area of the 0.002" aluminum diaphragm 18 from 0.136" by 0.083" to 0.156" by 0.087". This extends the diaphragm 18 to the maximum value it can be accommodated by the housing of the above referenced Model EH.

Figure 4:
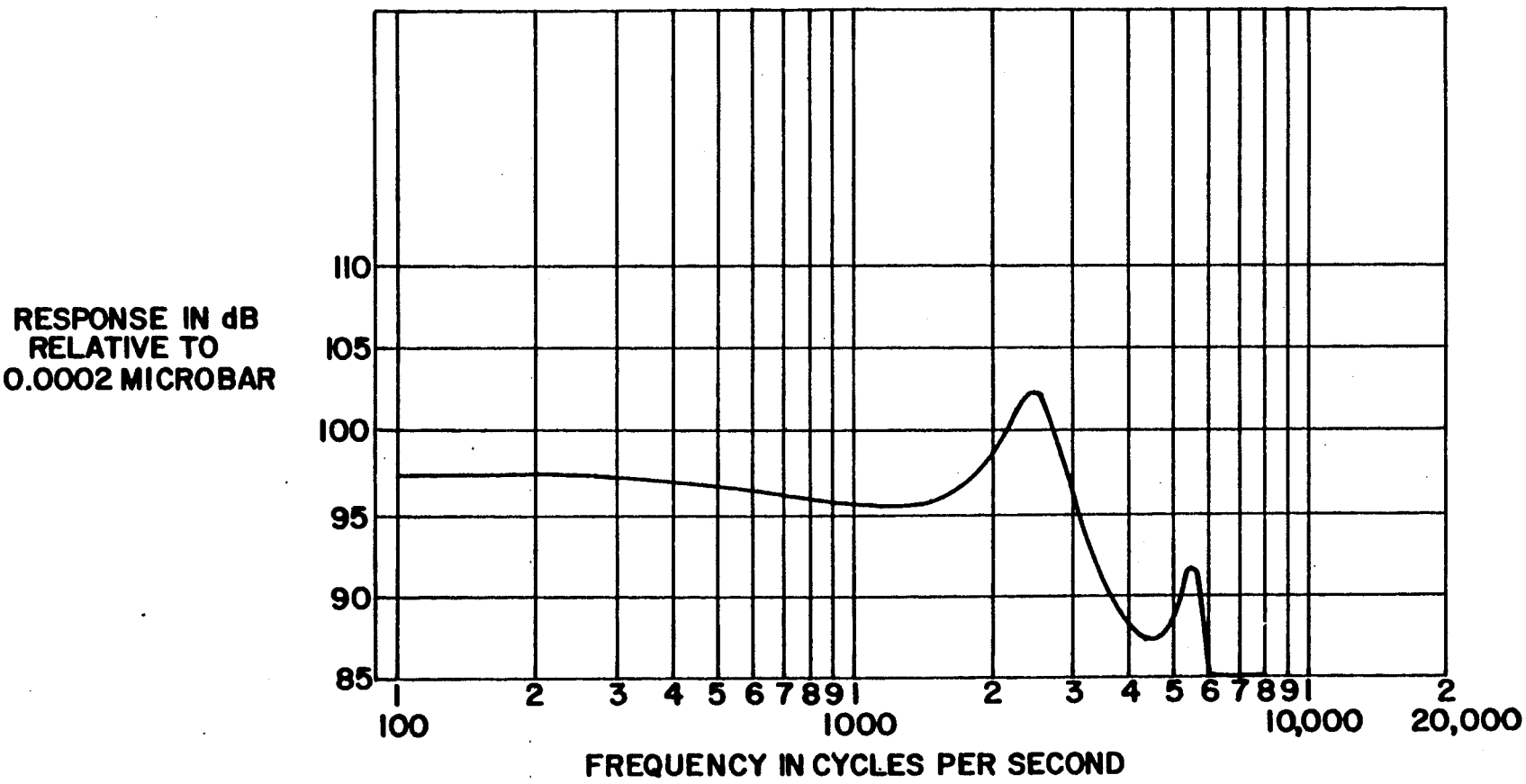
FIG. 4 is a plot of the output power versus frequency of the integrated receiver.

FIG. 4 shows a response curve of the integrated receiver 10 shown in FIG. 1. The desired 2.6 kHz resonance is achieved using the pulse width modulation amplifier described in the previously mentioned '819 patent.

Figure 6:
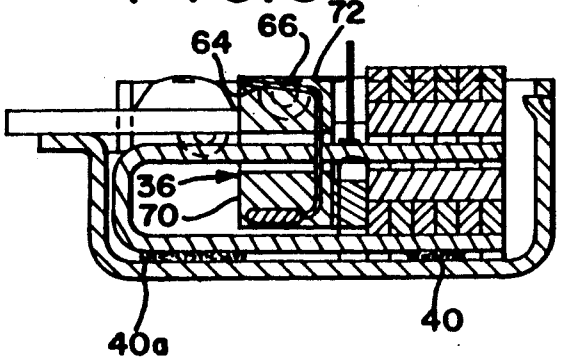
FIG. 6 is a view similar to FIG. 5, showing the final phase of a lead connection operation.
Figure 5:
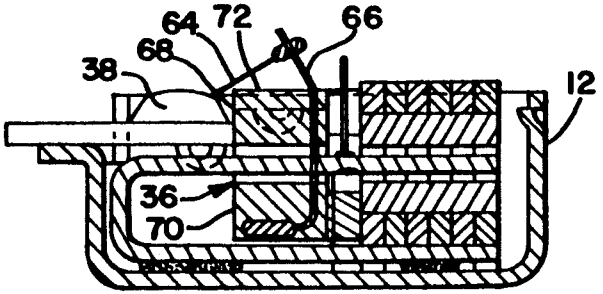
FIG. 5 is a cut away view of the integrated receiver of FIG. 1 at an intermediate phase of construction.

FIGS. 5 and 6 show Applicant's method for attaching the relatively heavy drive coil leads 66 to the relatively fragile amplifier output leads 64. The drive coil 36 is generally rectangular, having a top portion 68, a base portion 70, and a peripheral surface 72. The drive coil leads 66 are disposed to extend from the base portion preferably extending initially generally away from the amplifier 38, and are then brought up around peripheral sides of the coil 36. Ends of the leads 64,66 are extended towards each other and generally away from the interior of the lower portion of the housing 12. Near their outer ends, the leads 64,66 are brought into contact and are resistance welded by tweezers. The heavy drive coil lead 66 is then pulled downwards toward the amplifier 38, thereby folding the thin amplifier lead 64. This operation places no significant tensile stress on the amplifier lead 64. The terminal phase of the operation is to bend the lead 66 down to lie generally in contact with the peripheral surface 72 of the drive coil 36. This technique successfully minimizes lead breakage during assembly.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details.

I claim:

1. An integrated hearing aid receiver comprising:
a housing having a first outlet port;
a diaphragm disposed within said housing and defining a motor chamber and an output chamber, said output chamber communicating with said first outlet port;
an armature disposed within said motor chamber and having an operative element comprising a fixed end and a movable end;
coupling means for operably coupling said armature to said diaphragm;
a permanent magnet structure disposed about said armature movable end and providing a magnetic field at said armature movable end;
a drive coil disposed about said armature adjacent said permanent magnet structure; and
an amplifier coupled to said drive coil and disposed between said armature and said diaphragm.

2. The hearing aid receiver of claim 1 wherein said amplifier is disposed at said armature fixed end and adjacent to said drive coil.

3. The hearing aid receiver of claim 2 wherein said armature is configured as a U-shaped strap having opposed legs, one of said opposed legs being said operative element, the other of said legs being affixed to said housing.

4. The hearing aid receiver of claim 2 wherein said amplifier is a pulse width modulation amplifier.

5. The hearing aid receiver of claim 2 including:
a planar mounting board upon which said amplifier is mounted and having input and power terminals configured as metallizations extending to a common board edge;
a second outlet port communicating with said motor chamber; and
mounting means for mounting said mounting board to said housing with said metallizations extending outward from said housing through said second outlet port.

6. The hearing aid receiver of claim 1 wherein said permanent magnet structure and said drive coil are separated by a distance forming a gap therebetween, and said coupling means includes a link having first and second ends and extending into said gap, said first end being affixed to said operative element and said second end being affixed to said diaphragm.

7. The hearing aid receiver of claim 3 wherein;
said housing is generally rectangular having side, end, top, and bottom walls having generally planar interior surfaces;
said diaphragm is disposed to span between opposing side and end walls to form said output chamber between said diaphragm and said top wall and said motor chamber between said diaphragm and said bottom wall; and
said fixed end of said armature is affixed to the interior surface of said bottom wall.

8. The hearing aid receiver of claim 1 wherein: said drive coil has a base portion, a top portion, a peripheral surface, and drive coil leads extending from said base portion upwardly about said peripheral surface and terminating above said top portion; said amplifier has a plurality of output leads connected to respective ones of said drive coil leads to form joined portions, said joined portions being folded back substantially against said top portion and extending towards said amplifier.

9. The hearing aid receiver of claim 8 wherein said amplifier leads are of smaller gauge than said drive coil leads.

10. The hearing aid of claim 3 wherein said operative element of said armature is approximately 0.006 inches thick.

11. The hearing aid receiver of claim 1 wherein said other of said legs is secured to first portions of said permanent magnet structure and second portions of said permanent magnet structure are secured to said housing, so as to affix said other of said legs to said housing.

12. The hearing aid receiver of claim 7 wherein said fixed end of said armature is secured to first portions of said permanent magnet structure and second portions of said permanent magnet structure are secured to said interior surface of said bottom wall, so as to affix said armature to said interior surface of said bottom wall.

13. An integrated hearing aid receiver comprising:
a housing having generally rectangular side, end, top, and bottom walls having generally planar interior surfaces, and first and second outlet ports;
a diaphragm disposed within said housing to span between opposing side and end walls to form an output chamber between said diaphragm and said top wall and a motor chamber between said diaphragm and said bottom wall, said output chamber communicating with said first outlet port, said motor chamber communicating with said second outlet port;
an armature disposed within said motor chamber configured as a U-shaped strap having first and second opposed legs, said first leg being affixed to the bottom interior wall of said housing, said second leg terminating at a movable free end;
coupling means for operably coupling said second leg to drive said diaphragm;
a permanent magnet structure disposed about said second leg at said free end and providing a magnetic field at said free end;
a drive coil disposed about said second leg adjacent said permanent magnet structure;
a pulse width modulation amplifier coupled to said drive coil and disposed adjacent to said drive coil and between said second leg and said diaphragm;
a planar mounting board upon which said amplifier is mounted and having input and power terminals configured as metallizations extending to a common board edge; and
mounting means for mounting said mounting board to said housing with said metallizations extending outward from said housing through said second outlet port.

14. The hearing aid receiver of claim 13 wherein said first leg of said armature is secured to first portions of said permanent magnet structure and second portions of said permanent magnet structure are secured to said bottom interior wall of said housing, so as to affix said armature to said bottom interior wall of said housing.

15. In an integrated hearing aid receiver having:
an open-faced upper housing shell having a first outlet port and defining an output chamber;

an open-faced lower housing shell defining a motor chamber and configured for acceptingly receiving emplacement of said upper housing shell thereon;

a diaphragm disposed to span said open face of said lower housing shell;

an armature disposed within said motor chamber and having an operative element comprising a fixed end and a movable end;

coupling means for operably coupling said armature other end to drive said diaphragm;

a permanent magnet structure disposed about said movable end and providing a magnetic field at said movable end;

a drive coil disposed about said armature adjacent said permanent magnet structure; and an amplifier coupled to said drive coil and disposed between said armature and said diaphragm, said drive coil having a base portion, a top portion, a peripheral surface, and drive coil leads extending from said base portion upwardly about said peripheral surface and terminating above said top portion; said amplifier having a plurality of output leads connected to respective ones of said drive coil leads, a method for interconnecting said leads prior to emplacement of said diaphragm and said upper housing shell on said lower housing shell comprising the steps of:

withdrawing a pair of said leads to be connected to extend generally away from the interior of said lower housing shell, the drive coil lead of said pair extending also generally towards said amplifier;

placing the outer ends of said leads in contact with each other;

welding said lead ends together; and folding said leads back towards said amplifier and into said lower housing shell.

16. The method of claim 15 wherein said step of welding said lead ends together is done by tweezer welding.

17. The method of claim 15 wherein said amplifier leads are of smaller gauge than said drive coil leads.

* * * * *